US009850772B2

(12) United States Patent
Sarawate et al.

(10) Patent No.: US 9,850,772 B2
(45) Date of Patent: Dec. 26, 2017

(54) SEALS WITH A THERMAL BARRIER FOR TURBOMACHINERY

(71) Applicant: GENERAL ELECTRIC COMPANY, Schenectady, NY (US)

(72) Inventors: Neelesh Nandkumar Sarawate, Niskayuna, NY (US); Edip Sevincer, Watervliet, NY (US); Anthony Marin, Saratoga Springs, NY (US)

(73) Assignee: General Electric Company, Niskayuna, NY (US)

( * ) Notice: Subject to any disclaimer, the term of this patent is extended or adjusted under 35 U.S.C. 154(b) by 241 days.

(21) Appl. No.: 14/695,288

(22) Filed: Apr. 24, 2015

(65) Prior Publication Data

US 2016/0312635 A1 Oct. 27, 2016

(51) Int. Cl.
*F01D 25/00* (2006.01)
*F01D 11/00* (2006.01)

(52) U.S. Cl.
CPC ..... *F01D 11/005* (2013.01); *F01D 25/005* (2013.01); *F05D 2300/6033* (2013.01)

(58) Field of Classification Search
None
See application file for complete search history.

(56) References Cited

U.S. PATENT DOCUMENTS 5,997,247 A * 12/1999 Arraitz ..... F01D 11/005 277/543
7,150,926 B2 12/2006 Strangman
7,563,504 B2 7/2009 Mazzola et al.
7,887,929 B2 2/2011 Strock et al.
8,202,588 B2 6/2012 Keller et al.
8,309,197 B2 11/2012 Davis et al.
8,528,339 B2 9/2013 Morrison et al.
2004/0052637 A1* 3/2004 Paprotna ..... F01D 11/005 415/170.1
2005/0048305 A1 3/2005 Ackerman et al.
(Continued)

OTHER PUBLICATIONS

Staehler, et al; "Performance of Four Ceramic-Matrix Composite Divergent Flap Inserts Following Ground Testing on an F110 Turbofan Engine," Journal of the American Ceramic Society, Jul. 2000, pp. 1727-1738, vol. 83, Issue 7.
(Continued)

*Primary Examiner* — Dwayne J White
*Assistant Examiner* — Theodore Ribadeneyra
(74) *Attorney, Agent, or Firm* — John P. Darling

(57) ABSTRACT

Seal assemblies for reducing leakage between components of turbomachinery include a metallic shim, at least a pair of non-metallic end blocks, and ceramic fiber positioned between the shim and the end blocks. The shim may be mechanically coupled with the end blocks such that the metallic shim, end blocks and ceramic fiber are coupled. The end blocks account for misalignment of turbine components by ensuring sealing engagement of the seal to the components. The end blocks may be a ceramic or glass material, and the ceramic fiber may be a high temperature woven ceramic fiber. The ceramic fiber and/or the end blocks protect the metallic shim from reaching harmful temperatures during use of the seal, such as use in high temperature turbines including CMC components.

18 Claims, 11 Drawing Sheets

(56) References Cited

U.S. PATENT DOCUMENTS

| | | | | |
|---|---|---|---|---|
| 2006/0091617 | A1* | 5/2006 | Minnich | F01D 11/005 277/628 |
| 2013/0106066 | A1* | 5/2013 | Sarawate | F16J 15/128 277/641 |
| 2013/0161914 | A1* | 6/2013 | Sarawate | F16J 15/0812 277/654 |
| 2014/0062032 | A1* | 3/2014 | Wolfe | F16J 15/128 277/590 |
| 2014/0154062 | A1* | 6/2014 | Weber | F01D 11/00 415/174.4 |

OTHER PUBLICATIONS

Demange, et al; "Advanced Control Surface Seal Development for Future Space Vehicles," NASA, Jan. 2004, pp. 1-22.

David E. Glass; "Ceramic Matrix Composite (CMC) Thermal Protection Systems (TPS) and Hot Structures for Hypersonic Vehicles," 15th AIAA Space Planes and Hypersonic Systems and Technologies Conference, Mar. 2007, pp. 1-36.

* cited by examiner

SEALS WITH A THERMAL BARRIER FOR TURBOMACHINERY

BACKGROUND OF THE INVENTION

The present application relates generally to seals for reducing leakage, and more particularly to seals configured to operate within a seal slot to reduce leakage between adjacent stationary components of turbomachinery.

Leakage of hot combustion gases and/or cooling flows between turbomachinery components generally causes reduced power output and lower efficiency. For example, hot combustion gases may be contained within a turbine by providing pressurized compressor air around a hot gas path. Typically, leakage of high pressure cooling flows between adjacent turbine components (such as stator shrouds, nozzles, and diaphragms, inner shell casing components, and rotor components) into the hot gas path leads to reduced efficiency and requires an increase in burn temperature, and a decrease in engine gas turbine efficiency to maintain a desired power level as compared to an environment void of such leakage. Turbine efficiency thus can be improved by reducing or eliminating leakage between turbine components.

Traditionally, leakage between turbine component junctions is treated with metallic seals positioned in the seal slots formed between the turbine components, such as stator components. Seal slots typically extend across the junctions between components such that metallic seals positioned therein block or otherwise inhibit leakage through the junctions. However, preventing leakage between turbine component junctions with metallic slot seals positioned in seal slots in the turbine components is complicated by the relatively high temperatures produced in modern turbomachinery. Due to the introduction of new materials, such as ceramic-matrix composite (CMC) turbine components, that allow turbines to operate at higher temperatures (e.g., over 1,500 degrees Celsius) relative to traditional turbines, conventional metallic turbine slot seals for use in seal slots may not be adequate.

Preventing leakage between turbine component junctions with metallic seals is further complicated by the fact that the seal slots of turbine components are formed by corresponding slot portions in adjacent components (a seal positioned therein thereby extending across a junction between components). Misalignment between these adjacent components, such as resulting from thermal expansion, manufacturing, assembly and/or installation limitations, etc., produces an irregular seal slot contact surface that may vary in configuration, shape and/or magnitude over time. Such irregularities in the seal slot contact surface allow for leakage across a slot seal positioned within the seal slot if the seal does not flex, deform or otherwise account for such irregularities. Unfortunately, many conventional metallic shims that account for such irregular seal slot contact surfaces due to misalignment of adjacent turbine components may not adequately withstand increases in operating temperatures of turbines.

Accordingly, composite turbomachinery component junction seals configured for use in typical turbine seal slots that withstand the increasingly higher operating temperatures of turbines and conform to irregularities in the seal slot contact surface would be desirable.

SUMMARY OF THE INVENTION

In one aspect, the present disclosure provides a seal assembly for positioning within a seal slot formed at least partially by adjacent turbomachinery components to seal a gap extending between the components. The seal assembly includes a pair of end blocks, ceramic fiber and a metallic shim. The pair of end blocks may be ceramic or glass end blocks each including a sealing surface and a support surface. The ceramic fiber may overly at least a portion of the support surfaces of the end blocks. The metallic shim may overly at least a portion of the ceramic fiber and include a plurality of tabs. The plurality of tabs of the metallic shim may engage the end blocks to couple the end blocks, ceramic fiber and metallic shim.

In some embodiments, the pair of end blocks may abut along engagement surfaces thereof to form a joint, and the metallic shim may include at least one tab positioned on a first side of the joint and at least a second tap positioned on a second side of the joint that substantially opposes the first side of the joint. In some such embodiments, the joint between the end blocks may extend along the gap between the turbomachinery components when the seal assembly is positioned within the seal slot.

In some embodiments, the pair of end blocks may abut at engagement surfaces of the end blocks that extend along a length direction of the end blocks and a thickness direction extending between the sealing surfaces and the support surfaces of the end blocks, and the engagement surfaces may be configured to allow movement of the end blocks with respect to each other at least along the thickness direction. In some such embodiments, the metallic shim and the ceramic fiber may be deformable to allow the movement of the end blocks with respect to each other at least along the thickness direction. In some other such embodiments, the engagement surface of each of the end blocks may include at least a portion that extends along a width direction of the end blocks as it extends in the thickness direction. In some such embodiments, the engagement surface of each of the end blocks may include a planar surface extending between the sealing surface and the support surface of the respective end block. In some other such embodiments, the engagement surface of one of the end blocks may define a concave shape extending along the width direction, and the other of the end blocks may define a convex shape extending along the width direction.

In some embodiments, the end blocks may each include a least one channel configured to accept at least a portion of the metallic shim therein. In some such embodiments, each of the end blocks may include a channel positioned on substantially opposing sides of the end blocks along a length direction of the end blocks, and the plurality of tabs of the metallic shim may be positioned on substantially opposing sides of a construct formed by the end blocks along a width direction of the end blocks. In some such embodiments, the channels of each of the end blocks may be formed on the sealing surface of the end blocks, and the plurality of tabs of the metallic shim may extend along a thickness direction extending between the support surface and the sealing surface of the end blocks. In some other embodiments, end blocks may include channels positioned on substantially opposing sides of a construct formed by the end blocks along a width direction of the end blocks, and recesses positioned on substantially opposing sides of the end blocks along a length direction of the end blocks, and the channels and recesses may be positioned between the support surface and the sealing surface of the end blocks. In some such embodiments, the plurality of tabs of the metallic shim may extend along a thickness direction extending between the support surface and the sealing surface of the end blocks may be configured such that at least one tab is positioned at least partially within each of the channels and the recesses.

In some embodiments, the plurality of tabs may exert a pre-loaded force against the end blocks at least when the seal assembly is at ambient temperature. In some embodiments, the seal assembly may be installed in the seal slot, and the ceramic fiber may thermally insulate the metallic shim from the seal slot. In some embodiments, the ceramic fiber may include woven metal oxide fibers. In some such embodiments, the metal oxide fibers may be Al2O3 or Al2O3 and SiO2 fiber.

In another aspect, the present disclosure provides a turbomachine including a first turbine component, a second turbine component adjacent the first turbine component, and a seal. The first and second turbine components may form at least a portion of a seal slot extending across a gap between the turbine components. The seal may be positioned within the seal slot of the first and second turbine components and extend across the gap therebetween. The seal may include a pair of end blocks, ceramic fiber, and a metallic shim. The pair of end blocks may be a pair of ceramic or glass end blocks each including a sealing surface and a support surface. The ceramic fiber may overly at least a portion of the support surfaces of the end blocks. The metallic shim may overly at least a portion of the ceramic fiber and include a plurality of tabs. The plurality of tabs of the metallic shim may engage the end blocks to couple the end blocks, ceramic fiber and metallic shim.

In some embodiments, the pair of end blocks may abut along engagement surfaces thereof that extend along a length direction of the end blocks and a thickness direction extending between sealing surface and a support surface of the end blocks, and the engagement surfaces may be configured to allow the movement of the end blocks with respect to each other at least along the thickness direction. In some embodiments, the pair of end blocks may each include a least one channel configured to accept at least a portion of the metallic shim therein.

These and other objects, features and advantages of this disclosure will become apparent from the following detailed description of the various aspects of the disclosure taken in conjunction with the accompanying drawings.

DETAILED DESCRIPTION

Figure 1:
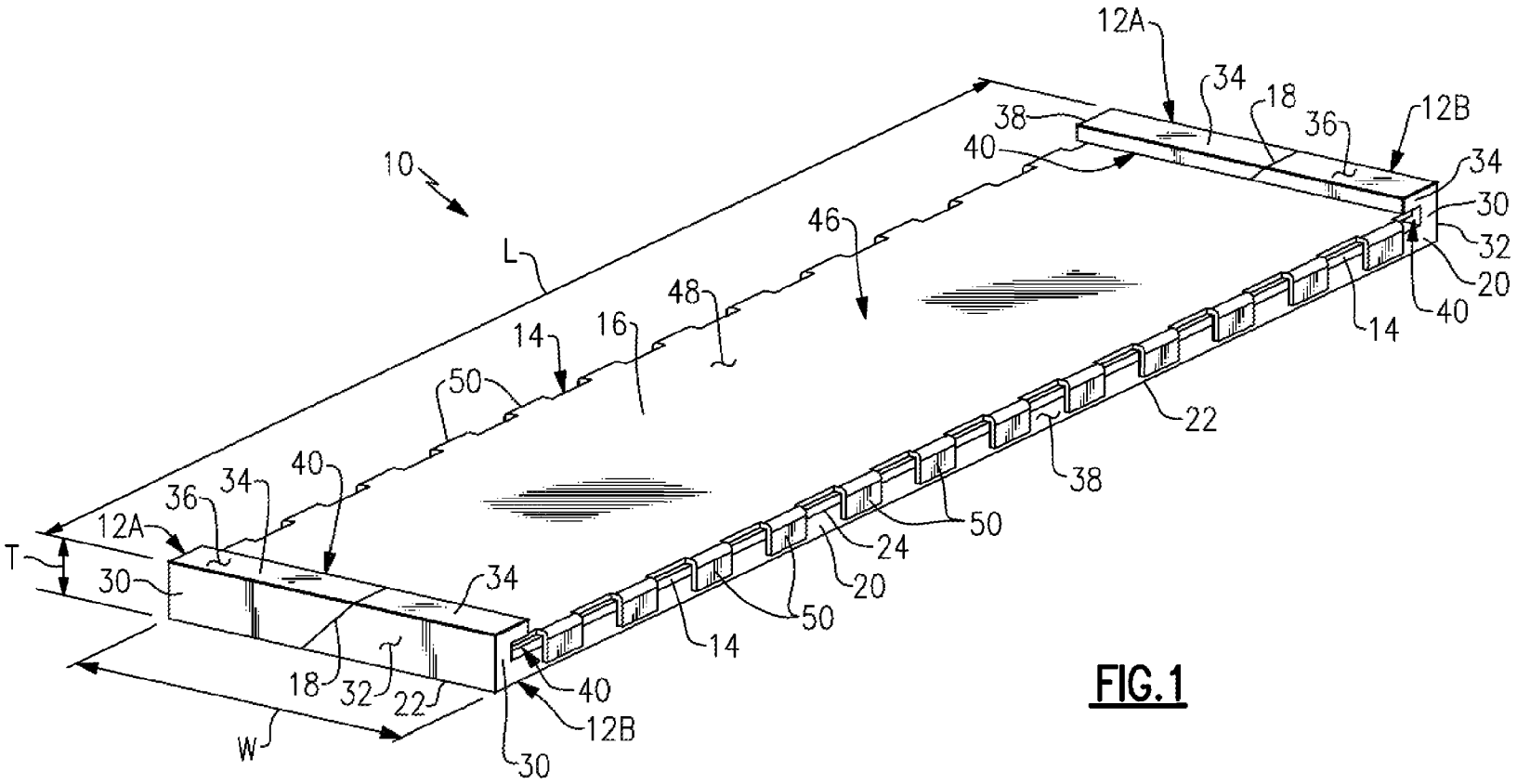
FIG. 1 is a perspective view of an exemplary seal assembly for use in a seal slot of a turbine according to the present disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments. Components, aspects, features, configurations, arrangements, uses and the like described, illustrated or otherwise disclosed herein with respect to any particular seal embodiment may similarly be applied to any other seal embodiment disclosed herein.

Composite turbomachinery component junction seals configured for use in turbine seal slots (e.g., composite turbine slot seals), and methods of manufacturing and using same, according to the present disclosure are configured to withstand the relatively high operating temperatures of turbines including CMC components and/or conform to irregularities in the seal slot contact surface. In particular, the composite slot seals are configured to substantially prevent chemical interaction and substantially limit thermal interaction of metallic components of the composite slot seals with the hot gas flow/leakage and/or the seal slot itself. In this way, the composite slot seals provided herein allow for use in high temperature turbine applications. In addition to high temperature operation, the composite slot seals of the present disclosure are configured to conform to irregularities on the seal slot contact surface to decrease leakage due to seal slot surface misalignment and/or roughness.

As shown in FIGS. 1-6, the exemplary seal 10 may be a seal assembly including at least one pair of non-metallic end blocks 12A, 12B, at least one metallic shim 16, and ceramic fiber 14 between the end blocks 12A, 12B and the at least one metallic shim 16 in the thickness T direction of the shim 10. When utilized in a seal slot of a turbine engine, the seal 10 may substantially block off or seal at least one junction or gap between turbine components and the ceramic fiber 14 (and, potentially, the end blocks 12A, 12B) may prevent at least the metallic shim 16 from reaching potentially harmful high temperatures (e.g., temperatures that result in silicide formation, thermal creep and/or increased wear of at least the metallic shim 16). Stated differently, the ceramic fiber 14 (and, potentially, the end blocks 12A, 12B) allows for the seal 10 to include the metallic shim 12 and yet be utilized in high temperature gas turbine applications without degradation of the metallic shim 12.

Figure 6:
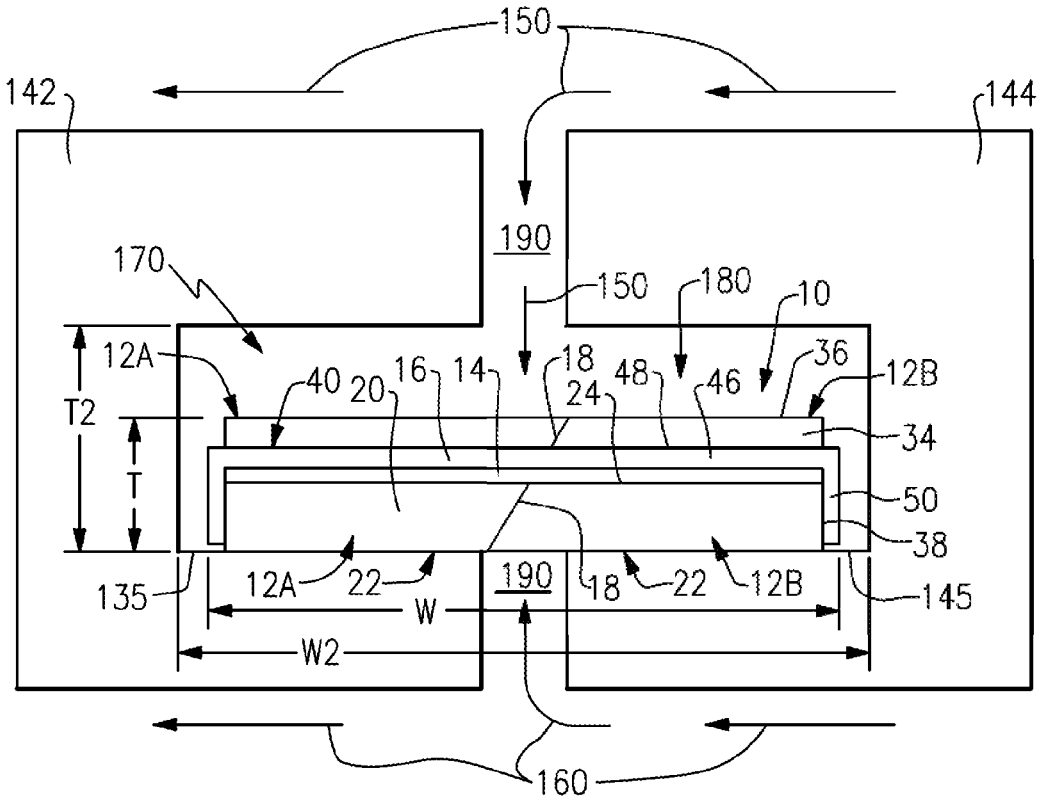
FIG. 6 is a side cross-sectional view of the seal assembly of FIG. 1 positioned within a seal slot to seal an exemplary junction between turbine components.

The at least one pair of end blocks 12A, 12B may be configured to engage sealing surfaces of a seal slot formed by at least two turbine components to seal a junction, joint or gap extending between the components, as shown in FIG. 6 and described further below. As such, the end blocks 12A, 12B may be made from a material that can withstand the high temperatures experienced in a seal slot of a turbine engine, such as a modern high temperature turbine including CMC components, and potentially may be machinable. For example, the end blocks 12A, 12B may be made from, or include, a ceramic or a glass material. In some embodiments, the end blocks 12A, 12B may be ceramic matrix composite (CMC) end blocks 12A, 12B including fibers and/or a matrix stable at temperatures above at least 1,800° C., such as fibers and/or a matrix of or including alumina, zirconia, silicon carbide (SiC), or carbon. In some other embodiments, the end blocks 12A, 12B may be glass end blocks 12A, 12B. In some embodiments, the end blocks 12A, 12B may be formed of a crystalline, glassy or glass ceramic composite. For example, the end blocks 12A, 12B may include, silicon nitride, silicon carbide, intermetallic compounds such as MAX phase materials (Ti2AlC) and combinations thereof. In some embodiments, the end blocks 12A, 12B may be formed of a machinable glass ceramic material. In some such embodiments, the end blocks 12A, 12B may be formed of a borosilicate glass material. For example, in some such embodiments the end blocks 12A, 12B may be formed of a machinable glass-ceramic sold under the trademark Macor® by Corning Inc. of Corning, N.Y. The end blocks 12A, 12B may each also be substantially effective in substantially preventing the passage of substances therethrough. For example, the end blocks 12A, 12B may be substantially solid or otherwise substantially impervious to at least one of gases, liquids and solids at pressures and temperatures produced in turbomachinery.

Figures 2A, 2B, 2C, 2D:
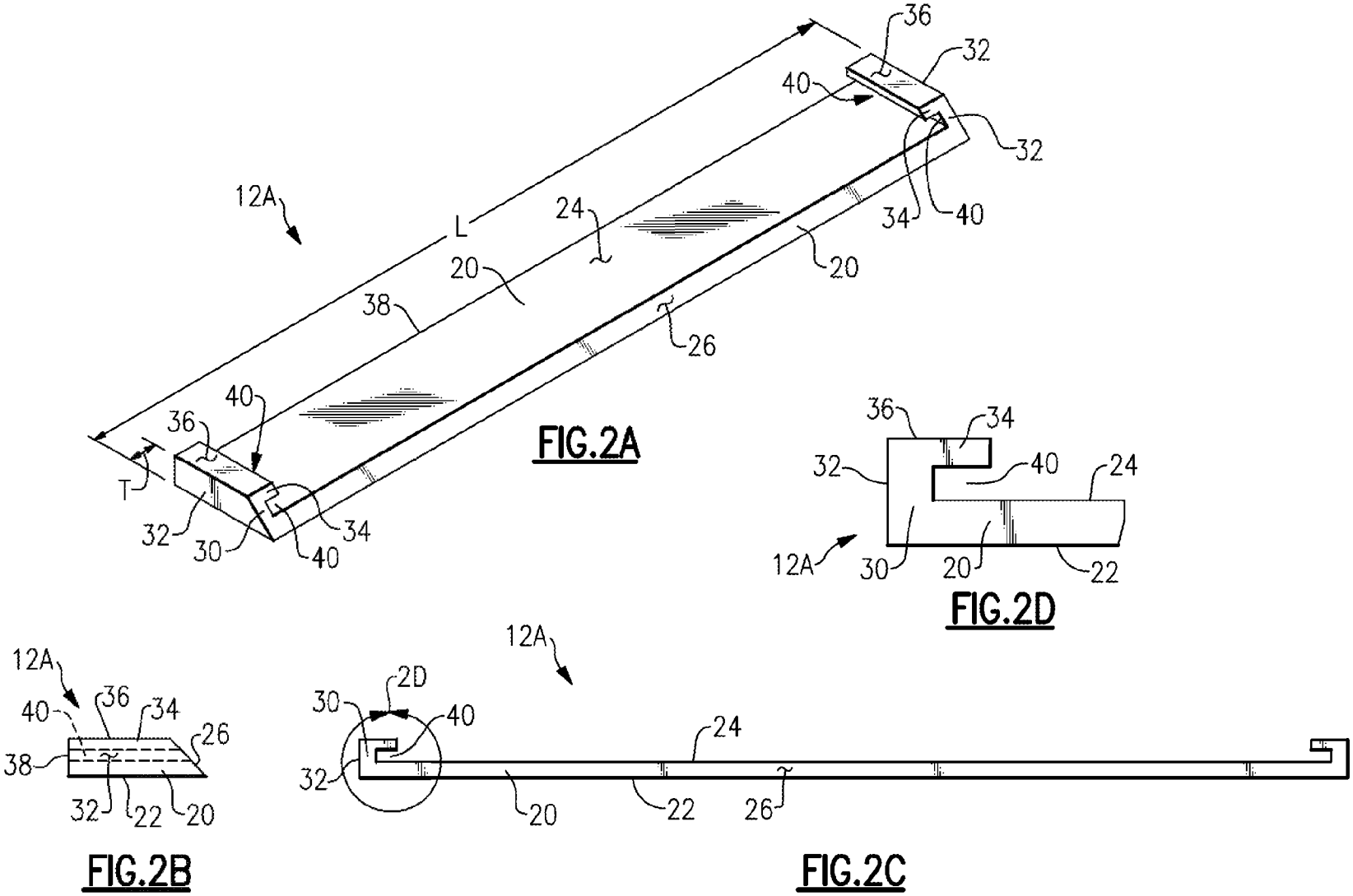
FIG. 2A is a perspective view of a first end block of the seal assembly of FIG. 1.
FIG. 2B is a front view of the first end block of the seal assembly of FIG. 1.
FIG. 2C is a side view of the first end block of the seal assembly of FIG. 1.
FIG. 2D is an enlarged side view of an end portion of the first end block of the seal assembly of FIG. 1.
Figure 3A:
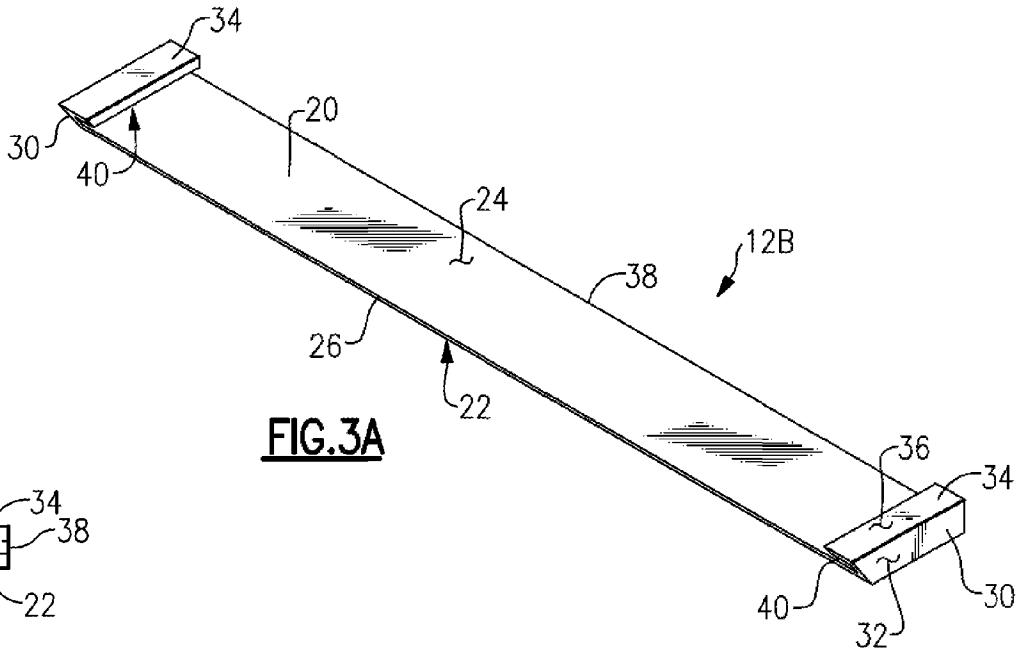
FIG. 3A is a perspective view of a second end block of the seal assembly of FIG. 1.

As shown in FIGS. 2A-3, each end block 12A, 12B may include or define a base portion 20, substantially opposing side wall portions 30 extending from the base portion 20 in the thickness direction T of the seal 10, and a distal portion 34 extending from each of the side walls 30. The base portion 20 of each end block 12A, 12B may include or define an exterior sealing surface or side 22. In some embodiments, the exterior sealing surface 22 of each end block 12A, 12B may be substantially planar (in a neutral state of the end blocks 12A, 12B). As explained further below, the exterior sealing surface 22 of each end block 12A, 12B may be configured to sealingly engage at least the sealing surfaces of a seal slot formed by first and second turbine components to substantially prevent gases, liquids and/or solids from migrating through a gap or joint between the first and second components. As such, the sealing surface 22 of each end block 12A, 12B may be shaped, sized and/or otherwise configured such that when the seal 10 is utilized in a seal slot of a turbine, the sealing surfaces 22 sealingly engage at least the corresponding sealing surfaces of the seal slot of the first and second turbine components.

As also shown in 2A-3, the base portion 20 of each end block 12A, 12B may include or define a support surface or side 24. The support surface 24 of each end block 12A, 12B may substantially oppose the sealing surface 22 thereof. In some embodiments, the support surface 24 of each end block 12A, 12B may be substantially planar (in a neutral state of the end blocks 12A, 12B). As explained further below, the support surfaces 24 of the end blocks 12A, 12B may act in concert with each other to provide support for ceramic fiber 14 positioned thereon or thereover. As such, the support surface 24 of each end block 12A, 12B may be shaped, sized and/or otherwise configured to provide support for ceramic fiber 14 thereon or thereover.

The end blocks 12A, 12B may further include substantially opposing side walls 30 extending from the base portion 20 along the thickness T of the seal 10 in a direction extending at least generally from the sealing surface 22 to the support surface 24. In this way, the side walls 30 of the end blocks 12A, 12B may define or include exterior or outer surfaces 32 that define the length L of the seal 10 (i.e., define the limit of the seal 10 in the length L direction), as shown in FIGS. 1 and 6. Stated differently, the side walls 30 of the end blocks 12A, 12B may define or include exterior or outer surfaces 32 that define the ends or outer edges of the seal 10 in the length direction L, as shown in FIGS. 1 and 6. In some embodiments, the side walls 30 may be substantially planar and extend substantially perpendicular to the base portion 20. For example, the exterior or outer surfaces 32 of the side walls 30 may be oriented substantially perpendicular to the sealing surface 22 and/or the support surface 24 of the base portion 20. However, in other embodiments the exterior or outer surfaces 32 of the side walls 30 may not be planar and/or oriented substantially perpendicular the sealing surface 22 and/or the support surface 24 of the base portion 20. Further, the side walls 30 may not be positioned on substantially opposing sides of the base portion 20 and/or define the length L of the seal 10. For example, the side walls 30 may define the width W of the seal 10.

The end blocks 12A, 12B may each further include distal portions 34 extending from the side walls 30 that are spaced from the base portion 20 along the thickness direction T of the seal, as shown in FIGS. 1-6. The distal portions 34 may extend substantially away from the exterior sides 32 of the side walls 30 along the length L of the seal 10 (e.g., towards the inner portion of the seal 10). Stated differently, the distal portions 34 of the end blocks 12A, 12B may extend from the side walls 30 and toward the interior or central portion of the seal 10, such as along the length L of the seal 10. In some embodiments, the distal portions 34 may be substantially planar and extend substantially parallel to the base portion 20. For example, the distal portions 34 may each include or define an exterior or outer upper surface 36 that is distal to the base portion 20 and an inner or lower surface that is proximate to the support surface 24 of the base portion 12 of the respective end block 12A, 12B, and such surfaces may be planar and oriented substantially parallel to the sealing surface 22 and/or the support surface 24 of the base portion 20 (and/or substantially perpendicular to the side walls 20). However, in other embodiments the upper surfaces 36 and/or lower surfaces of the distal portions 34 may not be planar and/or oriented substantially parallel to the sealing surface 22 and/or the support surface 24 of the base portion 20 (and/or substantially perpendicular to the side walls 20). The exterior or outer upper surfaces 36 of the distal portions 34 of the end blocks 12A, 12B may define the top or upper end of the seal 10 in the thickness T direction, as shown in FIGS. 1 and 6. As such, the distance between the exterior or outer upper surfaces 36 and the sealing surfaces 22 of the end blocks 12A, 12B may define or determine the thickness T of the seal 10, as shown in FIGS. 1 and 6.

As shown in FIGS. 1-6, the distal portions 34 may extend from the side walls 30 and toward the interior or central portion of the seal 10 substantially along the base portion 20. In this way, the base portion 20, side wall positions 30, and distal portions 34 may from a "C" shape as shown in FIGS.

2C, 2D and 3C (e.g., when viewed along the width W direction). The distal portions 34 may terminate before connecting or reaching each other, as shown in FIGS. 1-6. As such, at least an interior or central portion of the base portion 20 of each end block 12A, 12B may not be covered by or include the distal portions 34. At least an interior or central portion of the support surface 24 (e.g., along the length L) of each end block 12A, 12B may thereby be exposed or "open" in the thickness T direction of the seal 10.

The inwardly-facing C-shape formed by the inner or interior surfaces of the side wall positions 30 and the distal portions 34, and the support surface 24 of the base portion 20, of each end block 12A, 12B may form a channel, slot, groove or the like 40 that is accessible from an interior (e.g., of the length L) of the seal 10, as shown in FIGS. 1-6. The end blocks 12A, 12B may be configured such that the channels 40 extend along the entirely of the width W of the end blocks 12A, 12B. In some embodiments, the channels 40 may be positioned or arranged on substantially opposing sides of the end blocks 12A, 12B, such as opposing ends of the end blocks 12A, 12B along the length L direction.

Figure 3B:
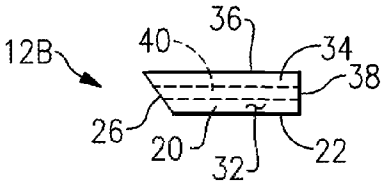
FIG. 3B is a front view of the second end block of the seal assembly of FIG. 1.
Figure 3C:
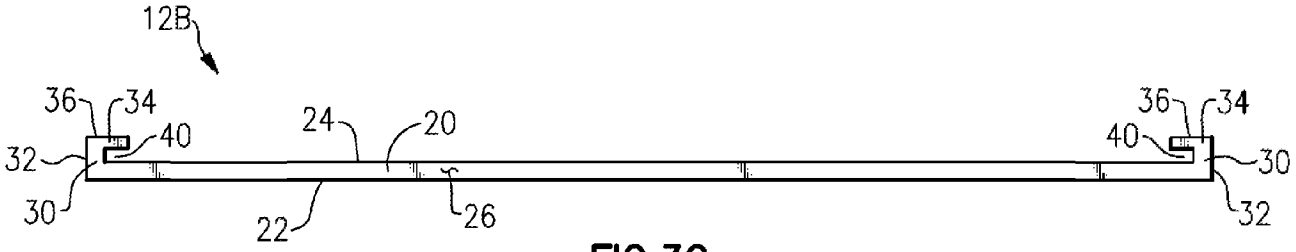
FIG. 3C is a side view of the second end block of the seal assembly of FIG. 1.
Figure 4:
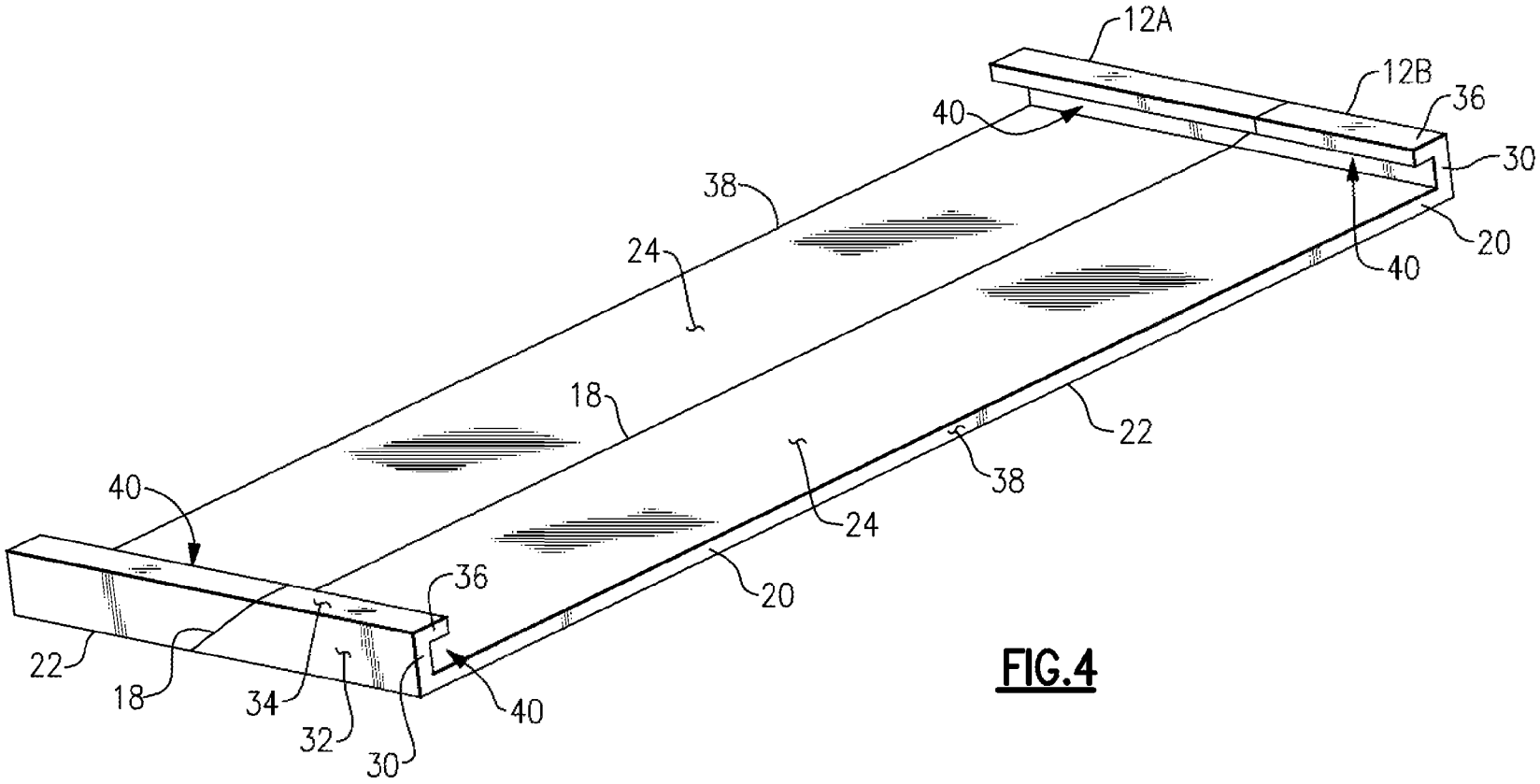
FIG. 4 is a perspective view of a sub-assembly of the first and second end blocks of the seal assembly of FIG. 1.
Figure 5:
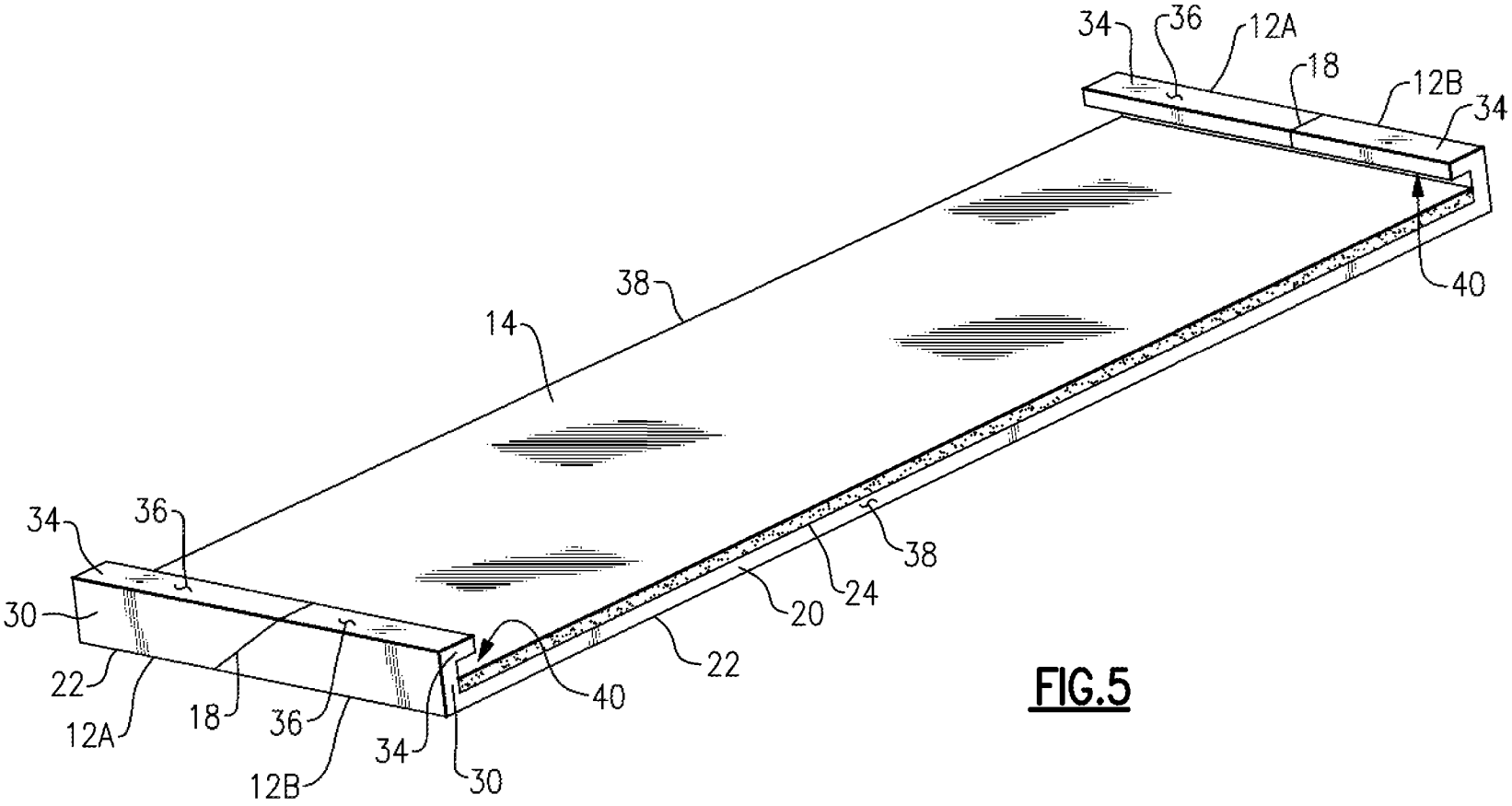
FIG. 5 is a perspective view of a sub-assembly of the first and second end blocks and ceramic fabric of the seal assembly of FIG. 1.

The end blocks 12A, 12B may be configured such that they mate in an abutting relationship to form a construct that supports the ceramic fiber 14 and metallic shim 16 to form the seal assembly 10, as shown in FIGS. 1 and 4-6. As shown in FIG. 4, the end blocks 12A, 12B may be configured or arranged such that they are adjacent to and abut each other along the width W direction, and are substantially aligned along the length L and thickness T directions (in a neutral state of the seal 10). In some embodiments, the support surfaces 24 of the end blocks 12A, 12B may be planar, and when the end blocks 12A, 12B are coupled, engaged or in abutment (and in a neutral state) the support surfaces 24 may be coplanar to form a two-piece planar surface to support the ceramic fiber 14 and metallic shim 16 thereon, as shown in FIGS. 4 and 5. Further, the end blocks 12A, 12B may be configured such that when they are coupled, engaged or in abutment (and in a neutral state) the channels 40 at respective ends or portions of the end blocks 12A, 12B mate and are substantially aligned or cooperate. When the end blocks 12A, 12B are coupled or in abutment, outer lateral sides or surfaces 38 of the end blocks 12A, 12B along the width W direction may form or define the outer lateral sides or surfaces of the construct formed by the end blocks 12A, 12B. As explained further below, the shim 16 may engage and/or couple to the outer lateral sides of the end blocks 12A, 12B to, at least in part, couple or secure the end blocks 12A, 12B to each other. The outer lateral sides or surfaces 38 of the end blocks 12A, 12B may be formed or defined by the base portion 20, side wall portions 30 and distal portions 34, as shown in FIGS. 2C and 3C.

As shown in FIGS. 1-5, the end blocks 12A, 12B may include or define inner engagement surfaces 26 that engage or abut with each other and form a joint or seam 18 therebetween when the end blocks 12A, 12B are coupled or in abutment (and in a neutral state) and form the seal 10. In some embodiments, the engagement surfaces 26 may extend through the thickness T of the end blocks 12A, 12B such that engagement surfaces 26 are formed or defined by the base portion 20, the side wall portions 30, and the distal portions 34, as shown in FIGS. 2C and 3C. The engagement surfaces 26 may be configured to allow the end blocks 12A, 12B to move with respect to each other, while maintaining contact or engagement therebetween, to allow the seal 10 to accommodate or adapt to seal slot misalignment or other situations involving non-aligned seal slot surfaces (e.g., misalignment along the thickness T and/or width W directions) while preventing an increase in leakage across the seal 10. In some embodiments, the engagement surfaces 26 of the end blocks 12A, 12B may be configured such that the joint or seam 18 therebetween substantially corresponds to (e.g., aligns with) a gap or junction between turbine components forming a seal slot for the seal 10 to allow or accommodate movement of the components, such as movement in the thickness T direction. Further, to provide contact or engagement of the end blocks 12A, 12B along the length L of the end blocks 12A, 12B, the shape, size, orientation or the like of the engagement surfaces 26 may substantially correspond or mimic each other (e.g., a mirror image).

In some embodiments, the engagement surfaces 26 of the end blocks 12A, 12B may be planar and angled as they extend along the thickness direction T. For example, as shown in FIGS. 2B and 3B, the engagement surfaces 26 of the end blocks 12A, 12B may be planar and angled along the width W direction as they extend along the thickness direction T. In such an embodiment, to provide for movement between the end blocks 12A, 12B while maintaining contact, abutment or engagement of the engagement surfaces 26, the engagement surface 26 of a first end block 12A may be angled toward the second end block 12B as it extends in the thickness direction T from the engagement surface or side 22 to the upper surface or side 36, while the second end block 12B may conversely be angled away the first end block 12A as it extends in the thickness direction T from the sealing surface or side 22 to the upper surface or side 36. In this way, the engagement surfaces 26 of the end blocks 12A, 12B may allow for motion or translation (e.g., sliding motion) between the end blocks 12A, 12B in the width W direction that results or provides relative translation of the end blocks 12A, 12B in the thickness T direction (and also allows for relative translation along the length direction L) while maintaining abutment or engagement thereof. As explained further below, other geometries or configuration of the engagement surfaces 26 of the end blocks 12A, 12B may allow for movement between end blocks 12A, 12B (e.g., along the thickness T, width W and/or length L directions), potentially while maintaining abutment or engagement thereof.

With the end blocks 12A, 12B in engagement or abutment as shown in FIG. 4, the ceramic fiber 14 may be positioned on or over the supporting surfaces 24 as shown in FIG. 5. As noted above, when the end blocks 12A, 12B are adjacent or in engagement or abutment, the supporting surfaces 24 may cooperate to form a platform, surface(s) or support mechanism for placement of the ceramic fiber 14 thereon or thereover. In some embodiments, the ceramic fiber 14 may include at least one layer of ceramic fiber or cloth that substantially covers or overlies the supporting surfaces 24 of the end blocks 12A, 12B. For example, the at least one layer of ceramic fiber 14 may be positioned on or over (e.g., abut) the supporting surfaces 24 and extend into the channels 40 of the blocks 12A, 12B, as shown in FIG. 5. In such embodiments, the end blocks 12A, 12B and/or ceramic fiber 14 may be configured such that the ceramic fiber 14 fills or occupies only a portion of channels 40 in the thickness T direction. In alternative embodiments (not shown), the ceramic fiber 14 may not substantially cover or overlie supporting surfaces 24 and/or be positioned within at least one channel 40. The ceramic fiber 14 may be relatively flexible or deformable such that the ceramic fiber 14 does not prevent relative movement of the end blocks 12A, 12B. Stated differently, the ceramic fiber 14 may be configured to allow the end blocks 12A, 12B to move with respect to each other, such as in the thickness T direction, in response to misaligned or a "rough" surface profile of a seal slot in which the seal 10 is utilized.

The ceramic fiber 14 may preferably act as a thermal barrier to the metallic shim 16 positioned on or over the ceramic fiber 14. Stated differently, the ceramic fiber 14 is preferably configured to decrease the conductance of heat from the seal slot holding the seal 10 to the metallic shim 16 (such as from the turbine components forming the seal slot and/or a hot flow passing through the gap or junction between the components and acting on the seal 10). As explained further below, the seal 10 may be utilized in a seal slot and oriented such that the sealing surface 22 of the end blocks 12A, 12B is positioned adjacent to, or interacts with, a flow or material (e.g., a combustion airflow) that is hotter than a flow or material (e.g., a cooling airflow) that is positioned adjacent to, or interacts with, the exterior surface 48 of the metallic shim 16. As such, the ceramic fiber 14 (potentially in concert the end blocks 12A, 12B) may be effective in preventing (or at least reducing the likelihood of) the metallic shim 16 from reaching potentially harmful high temperatures during use of the seal 10 in turbomachinery (e.g., temperatures that result in silicide formation, thermal creep and/or increased wear of the at least the metallic shim 16). Stated differently, the ceramic fiber 14 (and, potentially, the end blocks 12A, 12B) is preferably configured to allow the seal 10 to include the metallic shim 12 and be utilized in modern high temperature gas turbine applications, such as turbines including CMC components, without degradation of the metallic shim 18.

As such, the ceramic fiber 14 may be any ceramic fiber material that thermally insulates or otherwise acts as a thermal barrier to the metallic shim 16. In some embodiments, the ceramic fiber 14 (or the ceramic fiber 14 and the end blocks 12A, 12B) is configured to prevent the metallic shim 16 from reaching about 1800 degrees Fahrenheit when the seal 10 is used in a turbine engine, such as a turbine including CMC components. In some embodiments, the ceramic fiber 14 (or the ceramic fiber 14 and the end blocks 12A, 12B) is configured to prevent (or at least reducing the likelihood of) the metallic shim 16 from reaching about 1,500 degrees Fahrenheit when the seal 10 is used in a turbine engine, such as a turbine including CMC components.

The ceramic fiber 14 may be made of metal oxide fibers that have been woven or otherwise manufactured into a ceramic textile product, such as a fabric, cloth, tape, or sleeve. In some embodiments, the ceramic fiber 14 may be made of fibers of or including Al2O3 or Al2O3 and SiO2. For example, the ceramic fibers may be at least about 99 weight % Al2O3, or about 85 weight % Al2O3 and about 15 weight % SiO2. In some embodiments, the ceramic fiber 14 may be made of fibers including a crystalline or crystal structures based on alpha-Al2O3 or alpha-Al2O3 and mullite. In some embodiments, the ceramic fiber 14 may be at least one layer of woven ceramic fibers, such as Nextel™ ceramic textiles, fabrics or fibers sold by 3M™. In some such embodiments, the ceramic fiber 14 may be 3M™ Nextel™ 610 Ceramic Fiber or 3M™ Nextel™ 720 Ceramic Fiber.

As discussed above, to provide further thermal insulation or shielding to the metallic shim 16 of the seal 10 above the protection afforded by the ceramic fiber 14, the seal 10 may include glass end blocks 12A, 12B. Such glass end blocks 12A, 12B may lower the conductance of heat from the seal slot holding the seal 10 to the metallic shim 16 from that provided by the ceramic fiber 14 alone. For example, the glass end blocks 12A, 12B may include a relatively low thermal conductivity (e.g., as compared to ceramic (e.g., CMC) end blocks 12A, 12B) that acts in concert with the ceramic fiber 14 to decrease the conductance of heat to the metallic seal 16 to prevent (or at least reduce the likelihood of) the metallic shim 16 from reaching potentially harmful high temperatures during use of the seal 10 in turbomachinery. Glass end blocks 12A, 12B may also become relatively soft, deformable or pliable at temperatures found in seal slots of turbomachinery. In some such embodiments, the glass end blocks 12A, 12B may be configured to deform and conform (e.g., due to the temperature and pressure produced/experienced in seal slots of turbomachinery) to any misalignment or roughness profile within a seal slot to prevent an increase in leakage across the seal 10.

The seal assembly 10 may include at least one shim 16 that substantially covers or overlies the ceramic fiber 14 and/or the supporting surfaces 24 of the end blocks 12A, 12B. For example, the at least one shim 16 may be positioned on or over (e.g., abut) the ceramic fiber 14 (and over the supporting surfaces 24) and extend into the channels 40 of the blocks 12A, 12B, as shown in FIG. 1. In such embodiments, the end blocks 12A, 12B and/or ceramic fiber 14 may be configured such that the shim 16 and the ceramic fiber 14 substantially fills or occupies the channels 40 in the thickness T direction. In some embodiments, the channels 40 may exert a compressive force to the portion of the shim 16 (and, potentially, the ceramic fiber 14) positioned therein in the thickness T direction at least in a neutral state of the seal 10 (e.g., when the seal 10 is at ambient temperature). As the shim 10 may be positioned within the channels 40 of both of the end blocks 12A, 12B and the channels 40 may be positioned on substantially opposing sides or portions of the end blocks 12A, 12B (e.g., along sides or portions that define the length L of the end blocks 12, 12B), the shim 16 and the channels 40 may effectively couple or fix the end blocks 12A, 12B with respect to each other along at least one direction (e.g., along the length L direction).

The at least one metallic shim 16 may be effective in substantially preventing the passage of substances therethrough. For example, the metallic shim 16 may be substantially solid or otherwise substantially impervious to at least one of gases, liquids and solids at pressures and temperatures produced in turbomachinery. However, the metallic shim 16 may also provide flexibility at least in the thickness T direction at pressures and temperatures produced in turbomachinery to accommodate skews or offsets in the seal slot in which the seal 10 is utilized. For example, the metallic shim 16 may be relatively flexible or deformable such that the metallic shim 16 does not prevent relative movement (e.g., translation, twisting, bending, etc.) of the end blocks 12A, 12B. Stated differently, the metallic shim 16 may be configured to flex or deform to allow the end blocks 12A, 12B to move with respect to each other, at least in the thickness T direction, in response to misaligned or a "rough" surface profile of the seal slot in which the seal 10 is utilized.

In one embodiment, at least the portion of the shim 16 that overlies the ceramic fiber 14 and/or the support surfaces 24 of the end blocks 12A, 12B is a substantially solid metallic member or portion. The metallic shim 16 may be a high temperature metallic alloy or super alloy. For example, in some embodiments the shim 16 may be made from stainless steel or a nickel based alloy (at least in part), such as nickel molybdenum chromium alloy, Haynes 214, or Haynes 214 with an aluminum oxide coating. In some embodiments, the shim 16 may be made of a metal with a melting temperature of at least 1,500 degrees Fahrenheit, and more preferably at least 1800 degrees Fahrenheit. In some embodiments, the shim 16 may be made of a metal with a melting temperature of at least 2,200 degrees Fahrenheit.

As shown in FIG. 1, the metallic shim 16 may include a sealing portion 46 that substantially covers or overlies the ceramic fiber 14 and/or the support surfaces 24 of the end blocks 12A, 12B. In some embodiments, the ceramic fiber 14 may be adjacent, abut or underneath the entirety of the sealing portion 46 of the metallic shim 16. In this way, the ceramic fiber 16 may insulate at least the entirety of the sealing portion 46 of the metallic shim 16. In other embodiments, at least one portion of the sealing portion 46 of the metallic shim 16 may be void of the ceramic fiber 14. The shape or configuration of the sealing portion 46 of the metallic shim 16 may substantially correspond to that of the support surfaces 24 of the end blocks 12A, 12B. For example, the inner side, surface or portion of the sealing portion 46 may engage the ceramic fiber 14 and be positioned proximate to the support surfaces 24 of the end blocks 12A, 12B. As such, the inner side of the sealing portion 46 may be substantially planar (in a neutral state of the seal 10) and includes the substantially same width W and length L as that of the ceramic fiber 14 and/or support surfaces 24.

As also shown in FIG. 1, a portion of an outer side or surface 48 of the sealing portion 46 of the metallic shim 16 may be exposed. For example, the outer side or surface 48 of the sealing portion 46 that is not positioned in the channels 40 may be exposed. The exposed outer side or surface 48 of the sealing portion 46 of the metallic shim 16 may be configured to engage or interact with a cooling high pressure air flow flowing through at least one gap or joint between at least first and second components forming a seal slot (at least in part) holding the seal 10. The cooling high pressure air flow acting at least on the exposed outer side or surface 48 of the metallic shim 16 may force or press the seal (e.g., the sealing sides or surfaces 22 of the end blocks 12A, 12B) against or in contact with the sealing surfaces of the seal slot to substantially prevent gases, liquids and/or solids from migrating through the gap or joint. As such, the sealing portion 46 of the metallic shim 16 may be substantially impervious to liquids, gases and/or solids at pressures experienced in turbomachinery such that the seal 10 provides at least a low leakage rate past the seal slot. However, as described above, the sealing portion 46 of the metallic shim 16 may be flexible to allow relative movement between the end blocks 12A, 12B to account for skews, offsets or other non-aligned configurations of the sealing surfaces of the turbine components forming a seal slot that holds or retains the seal 10.

The metallic shim 16 may also include a plurality of tabs or projections 50 that extend from the sealing portion 46 on at least one side, edge or portion thereof that is not positioned within a channel 40, as shown in FIG. 1. The tabs 50 may be provided on substantially opposing sides of the shim 16. In the exemplary embodiment shown in FIG. 1, the sides of the sealing portion 46 defining the length L of the shim 16 are positioned within the channels 40, and the tabs 50 extend from the sides of the sealing portion 46 that extend between the channels 40 and define the width W of the shim 16. A plurality of tabs 50 may be provided on each side or portion of the sealing portion 46 that includes a tab 50.

The tabs 50 of the metallic shim 16 may be configured to hold together, couple, affix, abut or engage the end blocks 12A, 12B in at least one direction, such as along the width W direction. Further, the tabs 50 may couple or affix the shim 16 and the ceramic fiber 14 to the end blocks. For example, the tabs 50 may be angled or offset from the sealing portion 46 in the T thickness direction such that they extend over or past the outer edges or sides of the ceramic fiber 14 and the end blocks 12A, 12B. As shown in FIG. 1, the tabs 50 may extend away from the outer side or surface 48 of the sealing portion 46 and toward the sealing side or surface 22 of the end blocks 12A, 12B such that the tabs 50 extend past or over the outer lateral sides or surfaces of the ceramic fiber 14 and the outer lateral sides or surfaces 38 of the end blocks 12A, 12B (e.g., along the length L of the seal 10). The tabs 50 of the metallic shim 16 and the channels 40 of the end blocks 12A, 12B may cooperate to mechanically hold together, couple, affix or engage the end blocks 12A, 12B, ceramic fiber 14 and metallic shim 16 along each of the length L, width W, and thickness T directions. However, as noted above the metallic shim 16 is relatively flexible and the joint 18 extending between the end blocks 12A, 12B is configured to provide or allow movement of the end blocks 12A, 12B in at least the thickness T direction so that the seal 10 can maintain sealing engagement with a seal slot of a turbomachine that is (or becomes) offset or includes a "rough" profile.

The metallic shim 16 and the ceramic or glass end blocks 12A, 12B may include different coefficients of thermal expansion (hereinafter CTE). As a result, even though the metallic shim 16 may be cooler than the ceramic or glass end blocks 12A, 12B during use of the seal 10 in a seal slot of a turbomachine, the metallic shim 16 may expand or enlarge more than the ceramic or glass end blocks 12A, 12B. To account for the potential expansion of the metallic shim 16 with respect to the ceramic or glass end blocks 12A, 12B, the tabs 50 may be positioned against, adjacent or along the sides or surfaces of the end blocks 12A, 12B (e.g., deformed such that they are offset or angled with respect to the sealing portion 46 and against or adjacent the outer lateral sides or surfaces 38 of the end blocks 12A, 12B) with at least the metallic shim 16 heated, such as heated to at least about an operating temperature of a turbomachine. For example, the seal 10 may be heated to at least 1500 degrees Fahrenheit, or at least 1800 degrees Fahrenheit, and the tabs 50 may be deformed or positioned against or adjacent the sides or surfaces of the end blocks 12A, 12B. As the tabs 50 may be deformed or positioned in a heated state of the metallic shim 16 and the tabs 50 may be positioned on substantially opposing sides of the seal 10, the tabs 50 may be pre-stressed or pre-loaded at ambient temperature such that they exert a compressive force to the end blocks 12A, 12B. In some embodiments, the tabs 50 may be pre-loaded such that they are configured to exert a load or force, such as a compressive force, to the end blocks 12A, 12B at ambient temperature and at an operating temperature of the seal 10 (i.e., an operating temperature of a turbine). It is noted that that the load or force exerted by the tabs 50 against the end blocks 12A, 12B may be greater at ambient temperature that at an operating temperature.

The components of the seal 10 may include one or more protective coating (not shown) applied or positioned over or on surface thereof, or a portion thereof. For example, at least a portion of the metallic shim 16, such as an outer or exposed surface thereof, may include at least one protective coating or layer. The protective coating(s) of the metallic shim 16 may be configured to substantially prevent or retard oxidation of the metallic shim 10. In some embodiments, the protective coating(s) of the metallic shim 16 may include or substantially comprise an oxide, such as chromium oxide or alumina oxide. In some embodiments, the protective coating (s) of the metallic shim 16 may be configured to thermally insulate the metallic shim 10. For example, the metallic shim 16 may include a thermal barrier coating (TBC) overlying the metallic shim 16 that is configured to further thermally insulate the metallic shim 16 (in addition to the thermal insulation provided by the ceramic fiber 14 and, potentially, the end blocks 12A, 12B). In some embodiments, the TBC on the metallic shim 16 may include multiple layers, such as at least one metallic bond coat formed on the metallic shim 16, at least one thermally grown oxide (TGO) layer or region formed on or in the bond coat, and at least one ceramic topcoat formed or positioned on or over the TGO. In some embodiments, the ceramic topcoat may be composed of yttria-stabilized zirconia (YSZ) or a rare earth silicate or zirconate. The at least one ceramic topcoat may provide the largest thermal gradient of the TBC and function to the lower the temperature of any lower layers.

In some embodiments, the end blocks 12A, 12B may also include a protective coating. For example, at least a portion of the end blocks 12A, 12B, such the support surfaces 24 and/or the sealing surface 22, may include at least one protective coating or layer. The protective coating(s) of the end blocks 12A, 12B may be configured to substantially prevent or retard recession due to volatilization of the end blocks 12A, 12B, and/or thermally insulate the end blocks 12A, 12B. As such, the end blocks 12A, 12B may include a TBC and/or an environmental barrier coating (EBC). For example, the end blocks 12A, 12B may include an EBC overlying at least a portion thereof that is configured to prevent recession of the end blocks 12A, 12B due to volatilization, and, potentially, further thermally insulate the metallic shim 16 (in addition to the thermal insulation provided by the ceramic fiber 14 and, potentially, the end blocks 12A, 12B). In some embodiments, the EBC on the end blocks 12A, 12B may include multiple layers, such as at least one bond coat formed on end blocks 12A, 12B and at least one topcoat formed or positioned on or over the at least one bond coat. It is noted that ceramic embodiments of the end blocks 12A, 12B, such as CMC end blocks 12A, 12B, may particularly benefit from an EBC protective coating to prevent recession due to volatilization when the seal 10 is used in high temperature and/or moist environments.

FIG. 6 illustrates a cross-sectional view along the width W of the exemplary slot seal assembly 10 positioned within an exemplary seal slot to seal an exemplary junction between turbine components. Specifically, FIG. 6 shows a cross-section taken along the width W of a portion of an exemplary turbomachine including an exemplary first turbine component 142, an adjacent exemplary second turbine component 144, and the seal assembly 10 installed in the seal slot formed by the first and second components 142, 144. The first and second turbine components 142, 144 may be first and second stator components, such as first and second nozzles of first and second stators, respectively. In other embodiments, the first and second components 142, 144 may be any other adjacent turbomachinery components, such as stationary or translating and/or rotating (i.e., moving) turbine components. Stated differently, the seals described herein, such as seal 10, may be configured for, or used with, any number or type of turbomachinery components requiring a seal to reduce leakage between the components.

The cross-section of the exemplary components 142, 144 and the seal assembly 10 illustrated in FIG. 6 is taken along a width W of the structures, thereby illustrating an exemplary width W and thickness/height T of the structures. It is noted that the relative width W, thickness T and cross-sectional shape of the structures illustrated in FIG. 6 is exemplary, and the structures may include any other relative width, thickness and cross-sectional shape. Further, the length L of the structures (extending in-out of the page of FIG. 6) may be any length, and the shape and configuration of the structures in the length L direction may be any shape or configuration. It is also noted that although only two exemplary turbine components 142, 144 forming one seal slot is shown, a plurality of components may form a plurality of seal slots that are in communication with one another. For example, a plurality of turbine components may be circumferentially arranged such that seal slots formed thereby are also circumferentially arranged and in communication with one another. In such embodiments, the seals according to the present disclosure, such as seal 10, may be configured to span a plurality of seal slots to seal a plurality of gaps or junctions and thereby reduce leakage between a plurality of turbine components.

As shown in FIG. 6, the first and second adjacent turbine components 142, 144 may be spaced from one another such that a junction, gap or pathway 190 extends between the first and second adjacent components 142, 144. Such a junction 190 may thereby allow flow, such as airflow, between the first and second turbine components 142, 144. In some configurations, the first and second turbine components 142, 144 may be positioned between a first airflow 150, such as a cooling airflow, and a second airflow 160, such as hot combustion airflow. It is noted that the term "airflow" is used herein to describe the movement of any material or composition, or combination of materials or compositions, translating through the junction 190 between the first and second turbine components 142, 144.

To accept a seal that spans across the junction 190, and thereby block or otherwise cutoff the junction 190 and the first airflow 150 and the second airflow 160, the first and second adjacent components 142, 144 may each include a seal slot, as shown in FIG. 6. In the exemplary illustrated embodiment, the first component 142 includes a first seal slot 170 and the second component includes a second seal slot 180. The first and second seal slots 170, 180 may have any size, shape, or configuration capable of accepting a seal therein. For example, as shown in the illustrated exemplary embodiment in FIG. 6, the first and second seal slots 170, 180 may be substantially similar to one another and positioned in a mirrored relationship to define, in concert, a net slot or cavity that extends from within the first component 142, across the junction 190, and into the second component 144. In this manner, the pair of first and second seal slots 170, 180 may jointly or cooperatively form a cavity or seal slot to support opposing portions of the seal assembly 10 such that the seal 10 passes through the junction 190 extending between the adjacent components 142, 144.

In some arrangements with the first and second turbine components 142, 144 are adjacent, the first and second seal slots 170, 180 may be configured such that they are substantially aligned (e.g., in a mirrored or symmetric relationship). However, due to manufacturing and assembly limitations and/or variations, as well as thermal expansion, movement, or other factors, the first and second seal slots 170, 180 may be skewed, twisted, angled or otherwise misaligned. In other scenarios, the first and second seal slots 170, 180 may remain in a mirrored or symmetric relationship, but the relative positioning of the first and second seal slots 170, 180 may change (such as from use, wear or operating conditions). The term "misaligned" is used herein to encompass any scenario wherein seal slots have changed relative positions or orientations as compared to a nominal or initial position or configuration, such as a manufactured or assembled position or configuration.

With respect to the exemplary first and second seal slots 170, 180 of the exemplary first and second turbine components 142, 144 and the seal 10 of FIG. 6, in a misaligned configuration (not shown) the seal 10 is configured to account for the misalignment and maintain sealing contact of the end blocks 12A, 12B with the first and second seal slots 170, 180 to effectively cut off or eliminate the junction 190 extending between the first and second turbine components 142, 144 to thereby reduce or prevent the first and second airflows 150, 160 from interacting. More particularly, as shown in FIG. 6 the first and second airflows 150, 160 may interact with the junction 190 such that the first airflow 150 is a "driving" airflow that acts against the outer side or surface 48 of the metallic shim 16 of the seal 10 to force the sealing side or surfaces 22 of the end blocks 12A, 12B against first side surfaces 135, 145 of the first and second seal slots 170, 180, respectively. In such scenarios, the junction 18 formed by the engagement surfaces 26 of the end blocks 12A, 12B, and the flexible or deformable nature of the ceramic fiber 14 and the metallic shim 14, may allow relative movement of the end blocks 12A, 12B (e.g., in the thickness T direction) as a result of the forces applied by the first airflow 150 (e.g., above that applied by the second airflow 160) to account for any misalignment between the first and second seal slots 170, 180, but sufficiently stiff to resist being "folded" or otherwise "pushed" into the junction 190. Stated differently, in such a scenario, the exemplary seal 10 may be preferably sufficiently flexible, but yet sufficiently stiff, to maintain sealing engagement of the sealing side or surfaces 22 of the end blocks 12A, 12B of the shim 16 with the first side surfaces 135, 145, respectively, via the forces of the first airflow 150. For example, the metallic shim 16, the ceramic fiber 14, and the end blocks 12A, 12B may be configured to allow the seal 10 to conform to irregularities on the seal slot contact surfaces 135, 145. In addition to being sufficiently flexible to effectively seal the junction 190 in misalignment scenarios, as described above, the exemplary seal 10 may preferably be sufficiently stiff to satisfy assembly requirements.

The size of the seal 10 may be any size, but may be dependent upon, or at least related to, the components 142, 144 in which the seal 10 is installed. The thickness T of the exemplary seal 10 may be less than the thickness T2 of the first and second seal slots 170, 180, and thereby the thickness T2 of the net slot created by the first and second seal slots 170, 180 when the first and second adjacent components 142, 144 are assembled. In some embodiments, the thickness T of the exemplary seal 10 may preferably be within the range of about 0.01 inches to about ¼ inches, and more preferably within the range of about 0.05 inches to about 0.1 inches. Similarly, the width W of the seal 10 may be less than the width W2 of the net slot created by the first and second slots 170, 180 of the first and second components 142, 144, respectively, and the gap 190 between the components 142, 144 when the components 142, 144 are installed adjacent to one another. In some embodiments, the width W of the exemplary seal 10 may preferably be within the range of about 0.125 inches to about 0.75 inches.

As shown in the illustrated embodiment in FIG. 6, for example, the seal 10 may be positioned and arranged within the seal slot (i.e., the first and second seal slots 170, 180) such that the first or cooling airflow 150 acts against the outer side or surface 48 of the sealing portion 46 of the metallic shim 16 (and the upper surfaces 36 of the distal portions 34) to force the exterior sealing surface 22 of each end block 12A, 12B against the first side surfaces 135, 145 of the first and second seal slots 170, 180. Due to the impervious nature of the shim 16 and/or the end blocks 12A, 12B (and the end blocks 12A, 12B being in abutment), the seal 10 may thereby prevent the cooling airflow 150 from migrating through the gap 190 and into the second or hot combustion airflow 160. Further, the ceramic fiber 14 (and, potentially, the end blocks 12A, 12B) protects the metallic shim 16 from the high temperatures of the combustion airflow 160.

In this way, at least the shape and configuration of the sealing surfaces 22 of the end blocks 12A, 12B of the seal 10 (e.g., the surface that interacts with the exemplary first side surfaces 135, 145 or other sealing surfaces of the exemplary first and second seal slots 170, 180) may be related to the shape and configuration of the slots 142, 144 in which the seal 10 is installed, and the seal may be capable of adapting (e.g., moving, deforming, flexing, etc.) to changes or variations of the shape and configuration of the slots 142, 144 in which the seal 10 is installed. Stated differently, seal 10 may be configured to ensure sealing engagement with the first and second seal slots 170, 180 in which the seal 10 is installed. For example, in the illustrated example in FIG. 6, the sealing surfaces 22 of the end blocks 12A, 12B of the seal 10 may be substantially smooth (e.g., planar) and on the same plane to substantially abut or otherwise substantially engage the substantially smooth (e.g., planar) and on-plane first side surfaces 135, 145 of the first and second seal slots 170, 180 to effectively prevent or reduce leakage of the first airflow 150 between the seal 10 and the first side surfaces 135, 145 of the first and second seal slots 170, 180 and, ultimately, into the second or hot combustion airflow 160 (and to also protect the metallic shim 16 from the high temperatures of the hot combustion airflow 160). In some alternative embodiments (not shown), the shape and configuration of at least the sealing surfaces 22 of the end blocks 12A, 12B of the seal 10 may be shaped or configured differently than that of the corresponding sealing surfaces of the first and second seal slots 170, 180 (such as the exemplary first side surfaces 135, 145 of the first and second seal slots 170, 180 illustrated in FIG. 6). If the sealing surfaces of the first and second seal slots 170, 180 become misaligned or out of plane, the flexibility of the metallic shim 16 and the ceramic fiber 14 allow the end blocks 12A, 12B to move with respect to each other (e.g., at least in the thickness T direction) to maintain engagement of the sealing surfaces 22 with the first and second seal slots 170, 180 and the engagement surfaces 26 with each other to effectively prevent or reduce leakage of the first airflow 150 between the seal 10 and the first side surfaces 135, 145 of the first and second seal slots 170, 180 and, ultimately, into the second or hot combustion airflow 160.

FIGS. 7-13 illustrate of another exemplary slot seal assembly 110 according to the present disclosure. The exemplary slot seal assembly 110 has some similarities to the exemplary slot seal assembly 10 of FIGS. 1-6 described above, and therefore like reference numerals preceded with "1" are used to indicate like aspects or functions, and the description above directed to such aspects or functions (and the alternative embodiments thereof) equally applies to the exemplary slot seal assembly 110. As shown in FIGS. 7-13, seal assembly 110 differs from seal 10 with respect to the configuration of the end blocks 112A, 112B and the engagement of the metallic shim 116 with the end blocks 112A, 112B.

In the embodiments of FIGS. 7-13, the engagement surfaces 126 (see FIGS. 8-10, 12A and 12B) of the end blocks 112A, 112B of the seal 110 are non-planar. The engagement surfaces 126 of the first and second end blocks 112A, 112B are convex and concave, respectively, in the width W direction and configured to mate or nest in abutment (e.g., are substantially mirrored shapes), as shown in FIGS. 8-10, 12A and 12B. The engagement surface 126 of the first end block 112A is convex in the width direction such that it defines an apex or peak positioned at about midway of the thickness T of the first end block 112A. The engagement surface 116 of the first end block 112A includes portions positioned above and below the apex in the thickness T direction that are planar and extend from the support surface 124 and the sealing surface 122 to the apex. Similarly, the engagement surface 126 of the second end block 112B is concave in the width direction such that the deepest part of the concave shape in the width W direction is positioned at about midway of the thickness T of the first end block 112A. The engagement surface 116 of the second end block 112B includes portions positioned above and below in the thickness T direction the deepest portion of the concave shape in the width W direction that are planar and extend from the support surface 124 and the sealing surface 122 to the deepest portion of the concave shape. The convex and concave shaped engagement surfaces 126 of the end blocks 112A, 112B allow for the end blocks 112A, 112B to maintain contact or abutment under offsets (e.g., in the thickness direction) of the surfaces of the seal slot in which the seal 110 is utilized. In this way, the convex and concave shaped engagement surfaces 126 of the end blocks 112A, 112B prevent increases in leakage past or through the seal 10 when under offset seal slot conditions, as discussed above.

Figure 7:
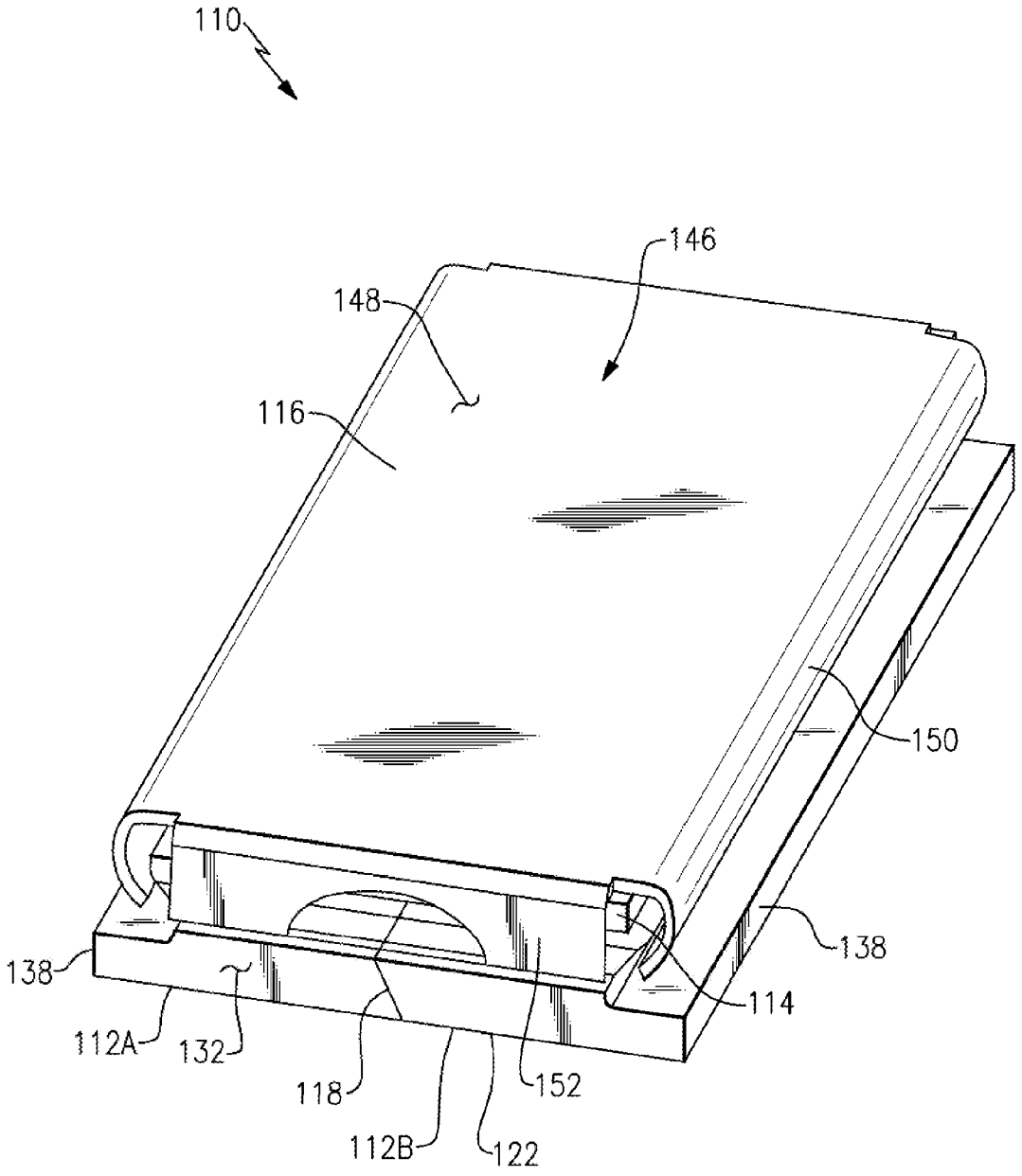
FIG. 7 is a perspective view of another exemplary seal assembly for use in a seal slot of a turbine according to the present disclosure.
Figure 8:
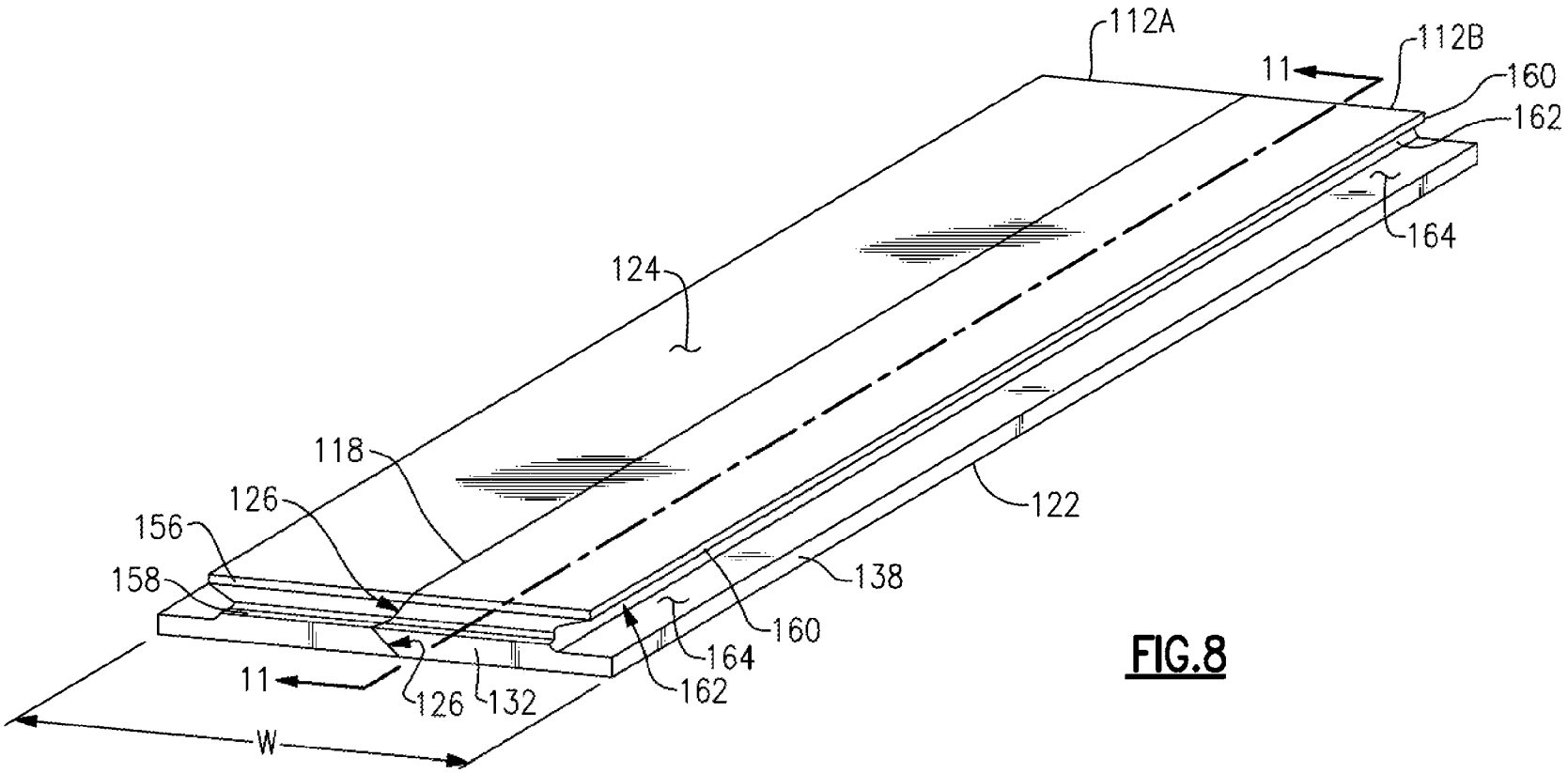
FIG. 8 is a perspective view of a sub-assembly of first and second end blocks of the seal assembly of FIG. 7.
Figure 9:
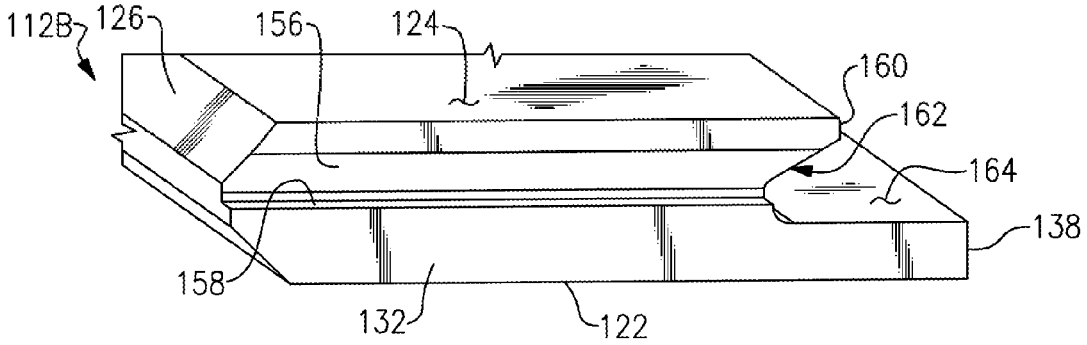
FIG. 9 is an enlarged perspective view of a portion of the first end block of the seal assembly of FIG. 7.
Figure 10:
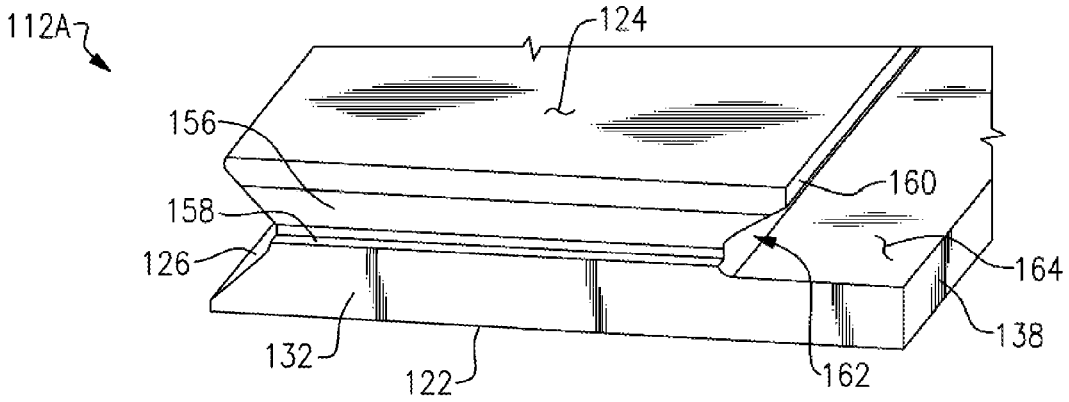
FIG. 10 is an enlarged perspective view of a portion of the second end block of the seal assembly of FIG. 7.
Figure 11:
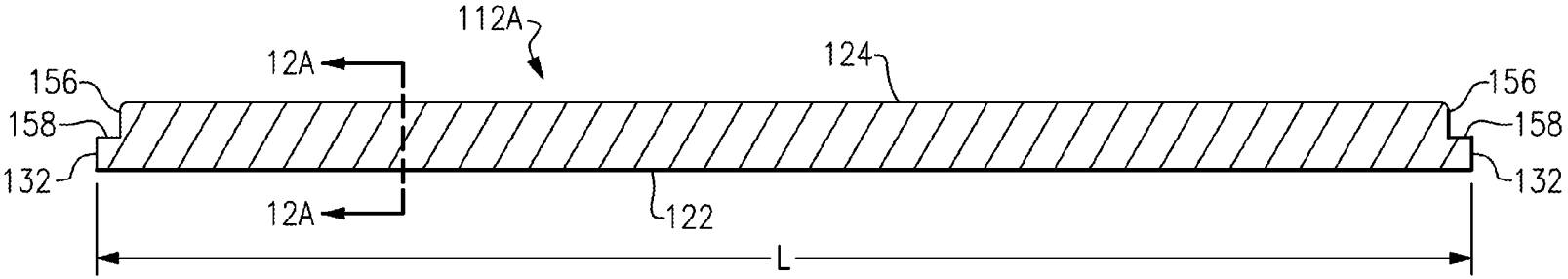
FIG. 11 is a cross-sectional view of the first end block of the seal assembly of FIG. 7.

As also shown in FIGS. 7-13, the end blocks 112A, 112B further differ from the end blocks 12A, 12B in that they are void of the channels 40 on the support surfaces 124 that are open to the interior of the length L of the end blocks 112A, 112B in which portions of the ceramic fiber 114 and/or metallic shim 116 are positioned. Rather, the end blocks 112A, 112B each include or define a recessed surface, side or portion 156 that is recessed along the length L direction from the exterior or outer surfaces 132 that define the length L of the end blocks 112A, 112B (i.e., define the limit of the seal 10 in the length L direction). The end blocks 112A, 112B each include or define a ledge surface, side or portion 158 that extends from the recessed surface 156 to the exterior surface 132 of the end blocks 112A, 112B. In some embodiments, the ledge surface 158 and/or the recessed surface 156 are/is substantially planar. In some embodiments, the recessed surface 156 includes at least a portion that is positioned further away from the corresponding exterior surface 132 than the portion of the recessed surface 156 that is positioned at or adjacent to the support surface 124. In some embodiments, the recessed surface 156 is positioned and/or oriented such that it is recessed an amount or distance in the length L direction from the exterior surface 132 of the end blocks 112A, 112B that is the same or greater than the thickness of the metallic shim 16 (and/or the ledge surface 158 extends a distance in the length L direction from the exterior surface 132 of the end blocks 112A, 112B to the recessed surface 156 that is the same or greater than the thickness of the metallic shim 116). As shown in FIGS. 7 and 11, the recessed surface 156 and the ledge surface 158 may cooperate to form a recess that accommodates at least one second tab portion 152 of the metallic shim 116. The at least one second tab portion 152 of the metallic shim 116 may extend from the sealing portion 146 and extend over or past the outer edge of the ceramic fiber 114 and over or along the recessed surface 156. In this way, the recessed surfaces 156 of the end blocks 112A, 112B and the at least one second tab portion 152 of the metallic shim 116 may substantially fix or couple the metallic shim 116, the ceramic fiber 114 and the end blocks 112A, 112B along the length L direction. As described above with respect to the tabs 50, the least one second tab portions 152 may be deformed or oriented in a heated state of the metallic shim 116 such that they exert a compressive force in a neutral state (i.e., at ambient temperature) of the metallic shim 116.

The portions of the end blocks 112A, 112B proximate to the outer lateral sides or surfaces 138 may also be configured with a channel or the like 162 configured to engage with the tabs 150 of the metallic shim 116. As shown in FIGS. 7-10 and 12A-13, the end blocks 112A, 112B may include or define a recessed lateral surface, edge or portion 160 that is positioned adjacent the support surface 124 and is recessed along the width W direction from the outer lateral sides or surfaces 138 that define the width W of the end blocks 112A, 112B (i.e., positioned interior in the width W direction with respect to the outer lateral sides or surfaces 138). The recessed lateral surface 160 may extend to a second ledge surface, side or portion 164 of the end blocks 112A, 112B that extends from the lateral recessed surface 160 and to the lateral side or surface 138 of the end blocks 112A, 112B. In some embodiments, the second ledge surface 164 may be planar and/or substantially parallel to the support surface 124 and/or the sealing surface 122. In some embodiments, at least a portion of the lateral recessed surface 160 that is adjacent to the support surface 124 of the end blocks 112A, 112B may be positioned and/or oriented such that it is recessed an amount or distance in the width W direction from the lateral side or surface 138 of the end blocks 112A, 112B that is the same or greater than the thickness of the metallic shim 116.

Figure 12B:
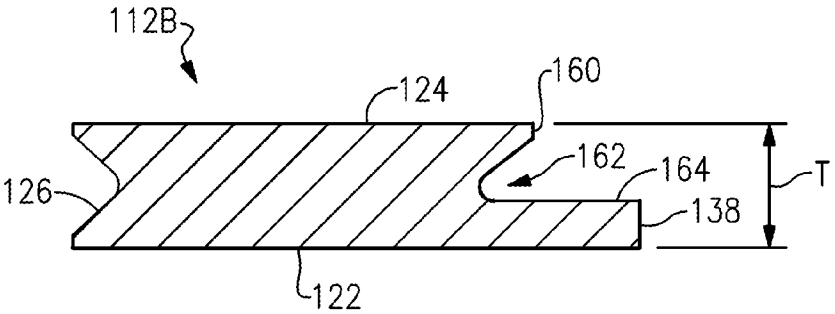
FIG. 12B is a cross-sectional view of the second end block of the seal assembly of FIG. 7.
Figure 12A:
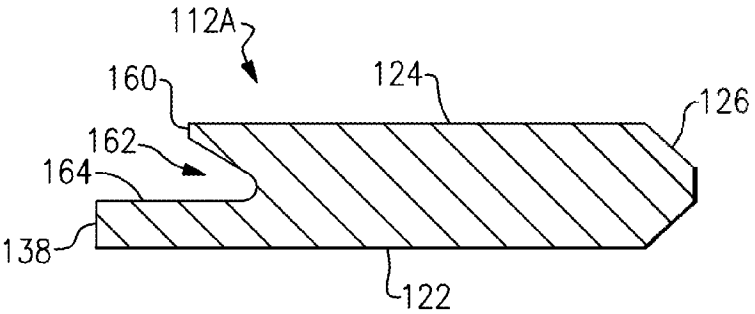
FIG. 12A is another cross-sectional view of the first end block of the seal assembly of FIG. 7.
Figure 13:
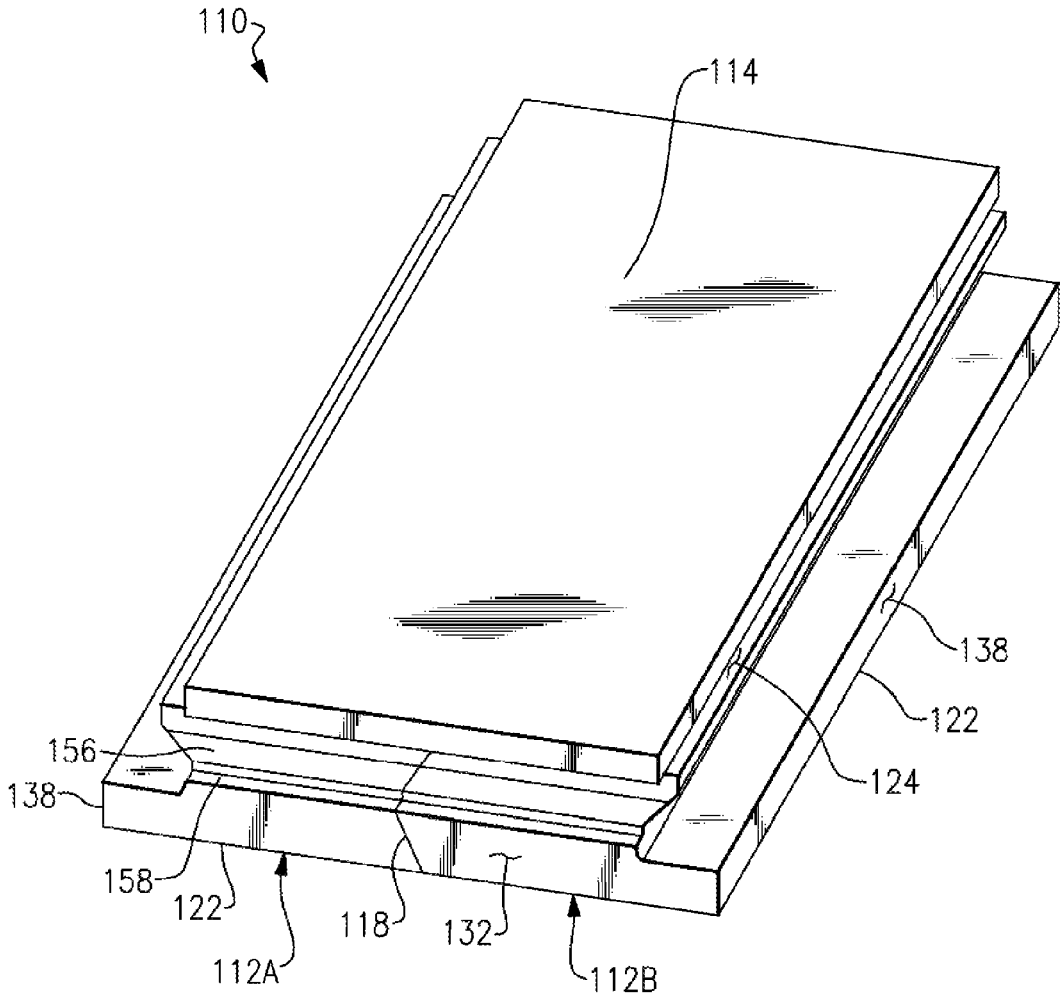
FIG. 13 is a perspective view of a sub-assembly of the first and second end blocks and ceramic fabric of the seal assembly of FIG. 7.

The lateral recessed surfaces 160 may include or define at least a portion that extends or is positioned further towards the interior of the respective end block 112A, 112B in the width W direction than the portion of the lateral recessed surface 160 that is adjacent the support surface 124 of the end blocks 112A, 112B, as shown in FIGS. 12A and 12B. In this way, the lateral recessed surface 160, and/or the lateral recessed surface 160 and the second ledge surface 164, may form the channel, slot, groove or other concave form or space 164 that extends into the interior of the respective end block 112A, 112B in the width W direction.

The channels 164 may be configured to accommodate at least one tab 150 of the metallic shim 116 therein, as shown in FIG. 7. When the seal 110 is assembled with the ceramic fiber 114 and the metallic shim 116, the at least one tab 150 of the metallic shim 116 may extend from the sealing portion 146 and over or past the outer later edges of the ceramic fiber 114 and over or along the lateral recessed surfaces 160 of the end blocks 112A, 112B, and thereby into the lateral channels 164 of the end blocks 112A, 112B. In this way, the lateral recessed surfaces 160 of the end blocks 112A, 112B and the tabs 150 of the metallic shim 116 may substantially fix or couple the metallic shim 116, ceramic fiber 114 and the end blocks 112A, 112B along the width W direction. The tabs 150 of the metallic shim 116 may also extend into the channels 164 in the width W direction such that the lateral recessed surfaces 160 of the end blocks 112A, 112B and the tabs 150 of the metallic shim 116 may substantially fix or couple the metallic shim 116, ceramic fiber 114 and the end blocks 112A, 112B along the thickness T direction. As described above, the tabs 150 of the metallic shim 116 may be deformed or oriented in a heated state of the metallic shim 116 such that they exert a compressive forced in a neutral state of the metallic shim 116. As shown in FIG. 7, the metallic shim 110 may include or define a singular tab 150 on each lateral side thereof, as opposed to the plurality of distinct spaced tab 50 of the seal 10 described above.

The seal assemblies disclosed herein provide low leakage rate similar to that possible with tradition slot seals, such as solid metal shim seals, while eliminating the silicide formation, thermal creep and increased wear concerns when applied to modern high temperature turbomachinery (e.g., turbomachinery including CMC components). Moreover, the seal assemblies disclosed herein may be less susceptible to manufacturing variations as compared to existing seals. The seal assemblies disclosed herein thus reduce leakage with low manufacturing and operational risks, and are applicable in both OEM and retrofit applications.

It is to be understood that the above description is intended to be illustrative, and not restrictive. Numerous changes and modifications may be made herein by one of ordinary skill in the art without departing from the general spirit and scope of the invention as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably connected" is used herein to refer to both connections resulting from separate, distinct components being directly or indirectly coupled and components being integrally formed (i.e., monolithic). Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. A seal assembly for positioning within a seal slot formed at least partially by adjacent turbomachinery components to seal a gap extending between the components, the seal assembly comprising:

a pair of ceramic or glass end blocks each including a sealing surface and a support surface;

ceramic fiber overlying at least a portion of the support surfaces of the end blocks; and a metallic shim overlying at least a portion of the ceramic fiber and including a plurality of tabs, wherein the plurality of tabs engage the end blocks to couple the end blocks, ceramic fiber and metallic shim, wherein the end blocks each include at least one channel configured to accept at least a portion of the metallic shim therein.

2. The seal assembly of claim 1, wherein the pair of end blocks abut along engagement surfaces thereof to form a joint, and wherein the metallic shim includes at least one tab positioned on a first side of the joint and at least a second tab positioned on a second side of the joint that substantially opposes the first side of the joint.

3. The seal assembly of claim 2, wherein the joint between the end blocks extends along the gap between the turbomachinery components when the seal assembly is positioned within the seal slot.

4. The seal assembly of claim 1, wherein the pair of end blocks abut at engagement surfaces of the end blocks that extend along a length direction of the end blocks and a thickness direction extending between the sealing surfaces and the support surfaces of the end blocks, and wherein the engagement surfaces are configured to allow movement of the end blocks with respect to each other at least along the thickness direction.

5. The seal assembly of claim 4, wherein the metallic shim and the ceramic fiber are deformable to allow the movement of the end blocks with respect to each other at least along the thickness direction.

6. The seal assembly of claim 4, wherein the engagement surface of each of the end blocks includes at least a portion that extends along a width direction of the end blocks as it extends in the thickness direction.

7. The seal assembly of claim 6, wherein the engagement surface of each of the end blocks comprises a planar surface extending between the sealing surface and the support surface of the respective end block.

8. The seal assembly of claim 6, wherein the engagement surface of one of the end blocks defines a concave shape extending along the width direction, and the other of the end blocks defines a convex shape extending along the width direction.

9. The seal assembly of claim 1, wherein each of the end blocks include a channel positioned on substantially opposing sides of the end blocks along a length direction of the end blocks, and wherein the plurality of tabs of the metallic shim are positioned on substantially opposing sides of a construct formed by the end blocks along a width direction of the end blocks.

10. The seal assembly of claim 9, wherein the channels of each of the end blocks are formed on the sealing surface of the end blocks, and wherein the plurality of tabs of the metallic shim extend along a thickness direction extending between the support surface and the sealing surface of the end blocks.

11. The seal assembly of claim 1, wherein the end blocks include channels positioned on substantially opposing sides of a construct formed by the end blocks along a width direction of the end blocks, and recesses positioned on substantially opposing sides of the end blocks along a length direction of the end blocks, and wherein the channels and recesses are positioned between the support surface and the sealing surface of the end blocks.

12. The seal assembly of claim 11, wherein the plurality of tabs of the metallic shim extend along a thickness direction extending between the support surface and the sealing surface of the end blocks are configured such that at least one tab is positioned at least partially within each of the channels and the recesses.

13. The seal assembly of claim 1, wherein the plurality of tabs exert a pre-loaded force against the end blocks when the seal assembly is at ambient temperature.

14. The seal assembly of claim 1, wherein when the seal assembly is installed in the seal slot, the ceramic fiber thermally insulates the metallic shim from the seal slot.

15. The seal assembly of claim 1, wherein the ceramic fiber includes woven metal oxide fibers.

16. The seal assembly of claim 15, wherein the metal oxide fibers are at least 99% $Al_2O_3$ or 85% $Al_2O_3$ and 15% $SiO_2$ fiber.

17. A turbomachine comprising:

a first turbine component and a second turbine component adjacent the first turbine component, the first and second turbine components forming at least a portion of a seal slot extending across a gap between the turbine components; and a seal positioned within the seal slot of the first and second turbine components and extending across the gap therebetween, the seal comprising:

a pair of ceramic or glass end blocks each including a sealing surface and a support surface;

ceramic fiber overlying at least a portion of the support surfaces of the end blocks; and a metallic shim overlying at least a portion of the ceramic fiber and including a plurality of tabs, wherein the plurality of tabs engage the end blocks to couple the end blocks, ceramic fiber and metallic shim, wherein the pair of end blocks each include a least one channel configured to accept at least a portion of the metallic shim therein.

18. The turbomachine of claim 17, wherein the pair of end blocks abut along engagement surfaces thereof that extend along a length direction of the end blocks and a thickness direction extending between sealing surface and a support surface of the end blocks, and wherein the engagement surfaces are configured to allow the movement of the end blocks with respect to each other at least along the thickness direction.

* * * * *